US009779599B2

(12) United States Patent
Sharpy et al.

(10) Patent No.: US 9,779,599 B2
(45) Date of Patent: Oct. 3, 2017

(54) ALARMING SMART MAGNETIC TAG

(71) Applicants: Anthony Sharpy, Southgate, MI (US); Randy J. Zirk, Delray Beach, FL (US); Gilbert Fernandez, Weston, FL (US)

(72) Inventors: Anthony Sharpy, Southgate, MI (US); Randy J. Zirk, Delray Beach, FL (US); Gilbert Fernandez, Weston, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/178,110

(22) Filed: Jun. 9, 2016

(65) Prior Publication Data

US 2016/0364968 A1 Dec. 15, 2016

Related U.S. Application Data

(60) Provisional application No. 62/174,796, filed on Jun. 12, 2015.

(51) Int. Cl.
*G08B 13/14* (2006.01)
*G08B 13/24* (2006.01)

(52) U.S. Cl.
CPC ..... *G08B 13/242* (2013.01); *G08B 13/246* (2013.01)

(58) Field of Classification Search
CPC ..... G06K 19/077; G06K 19/07749; G06K 19/07758; G06K 19/0723; G08B 13/2402; G08B 13/242; G08B 13/2434; G08B 13/246
USPC ..... 340/572.1, 572.3, 572.8, 572.9, 571
See application file for complete search history.

(56) References Cited

U.S. PATENT DOCUMENTS 5,955,951 A 9/1999 Wischerop et al.
7,812,706 B2 * 10/2010 Suzuki ..... G06K 19/07758 340/572.8
8,094,026 B1 1/2012 Green
2005/0190060 A1 * 9/2005 Clancy ..... G08B 13/246 340/572.9
2007/0131005 A1 * 6/2007 Clare ..... E05B 47/0603 340/572.9
2008/0100457 A1 5/2008 Gray
2011/0227706 A1 * 9/2011 Yang ..... G08B 13/2434 340/10.1

(Continued)

FOREIGN PATENT DOCUMENTS

EP 2759975 A1 7/2014
FR 2614186 A1 10/1988
WO 01/80193 A1 10/2001

OTHER PUBLICATIONS

PCT International Search Report and Written Opinion of the International Searching Authority (EPO) for International Application No. PCT/US2016/036859 (dated Sep. 22, 2016).

*Primary Examiner* — Thomas Mullen
(74) *Attorney, Agent, or Firm* — Fox Rothschild LLP; Robert J. Sacco; Carol E. Thorstad-Forsyth

(57) ABSTRACT

Systems and methods for operating a security tag (132, 300). The methods comprise: wirelessly receiving at the security tag a signal sent from a remote device (104, 190); and preventing alarm issuance when first and second Magnetic Attracting ("MA") halves (302, 312, 702, 704) of the security tag are pulled apart by deactivating alarm circuitry (264, 340) internal to the security tag in response to the security tag's reception of the signal.

20 Claims, 12 Drawing Sheets

(56) References Cited

U.S. PATENT DOCUMENTS

| | | | | |
|---|---|---|---|---|
| 2014/0085089 | A1 | 3/2014 | Rasband | |
| 2015/0048946 | A1* | 2/2015 | Luo | G08B 13/2434 340/572.8 |
| 2017/0030109 | A1 | 2/2017 | Duncan et al. | |

* cited by examiner

ALARMING SMART MAGNETIC TAG

CROSS-REFERENCE TO RELATED APPLICATIONS

This application claims priority to U.S. patent application Ser. No. 62/174,796, filed Jun. 12, 2015. The contents of the above application are incorporated by reference in its entirety.

FIELD OF THE INVENTION

This document relates generally to security tags used in Electronic Article Surveillance ("EAS") systems. More particularly, this document relates to security tags and methods for facilitating self-checkout.

BACKGROUND OF THE INVENTION

A typical EAS system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be detached therefrom. Consequently, the article can be carried through the surveillance zone without being detected by the monitoring system and/or without triggering the alarm.

Radio Frequency Identification ("RFID") systems may also be used in a retail setting for inventory management and related security applications. In an RFID system, a reader transmits a Radio Frequency ("RF") carrier signal to an RFID device. The RFID device responds to the carrier signal with a data signal encoded with information stored by the RFID device. Increasingly, passive RFID labels are used in combination with EAS labels in retail applications.

As is known in the art, security tags for security and/or inventory systems can be constructed in any number of configurations. The desired configuration of the security tag is often dictated by the nature of the article to be protected. For example, EAS and/or RFID labels may be enclosed in a rigid tag housing, which can be secured to the monitored object (e.g., a piece of clothing in a retail store). The rigid housing typically includes a removable pin which is inserted through the fabric and secured in place on the opposite side by a mechanism disposed within the rigid housing. The housing cannot be removed from the clothing without destroying the housing except by using a dedicated removal device.

A typical retail sales transaction occurs at a fixed Point Of Sale ("POS") station manned by a store sales associate. The store sales associate assists a customer with the checkout process by receiving payment for an item. If the item is associated with an EAS/RFID element, the store sales associate uses the dedicated removal device to remove the security tag from the purchased item.

A retail sales transaction can alternatively be performed using a mobile POS unit. Currently, there is no convenient way to detach a security tag using a mobile POS unit.

Options include: the use of a mobile detacher unit in addition to a mobile POS unit; the use of a fixed detacher unit located within the retail store which reduces the mobility of the mobile POS unit; or the use of a fixed detacher unit located at an exit of a retail store which burdens customers with a post-POS task. None of these options is satisfactory for large scale mobile POS adaption in a retail industry.

SUMMARY OF THE INVENTION

The present disclosure is directed to systems and methods for operating a security tag. The methods involve wirelessly receiving at the security tag a signal sent from a remote device. The signal may be sent from the remote device when a successful purchase of an article has occurred. Alarm issuance is prevented when first and second Magnetic Attracting ("MA") halves of the security tag are pulled apart by deactivating alarm circuitry internal to the security tag in response to the security tag's reception of the signal. Notably, the first and second MA halves are able to be manually pulled apart by a user without assistance from a dedicated security tag detacher device.

In some scenarios, an alert may be output indicating that: the alarm circuitry has been deactivated so that a user knows when to pull the first and second MA halves of the security tag apart without alarm issuance; and/or the security tag has not been decoupled from an article after the alarm circuitry's deactivation. The alarm circuitry may be deactivated by ceasing a supply of power to the alarm circuitry. The security tag may be coupled to the article by clamping the article between the first and second MA halves.

In those or other scenarios, a switch (e.g., a magnetic reed switch) is disposed in the security tag. The switch is opened by placing the first and second MA halves in proximity to each other. Alarm issuance is caused by placing the first and second MA halves a certain distance apart whereby the switch is closed.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
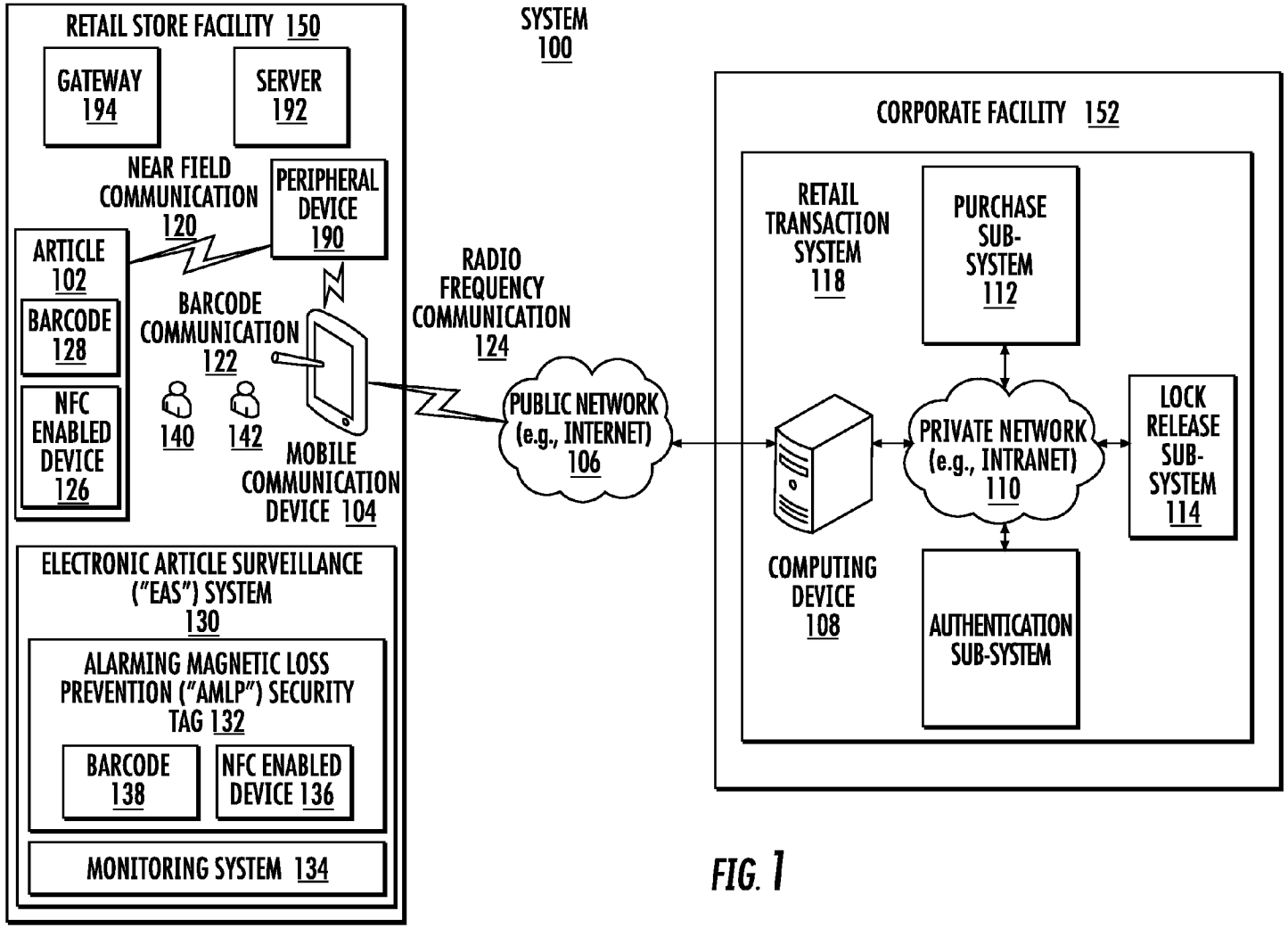
FIG. 1 is a schematic illustration of an exemplary system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present disclosure concerns an Alarming Magnetic Loss Prevention ("AMLP") tag, and revolves around the need for devices tailored to customer self-checkout. A new design was developed to address a pyridine shift in securing merchandise that currently has no solutions and would enable works with self-pay, express lane, kiosk, mobile shopping applications and shopping websites.

The AMLP security tag allows a customer to make a secure purchase of an item through a Mobile Point Of Sale ("MPOS") device and an online payment service (e.g., PayPal® or other cloud based online service). RFID technology is incorporated in the AMLP security tag to facilitate the reading and deactivation of the AMLP security tag upon completion of a successful purchase transaction. After deactivation of the AMLP security tag, two Magnetic Attracting ("MA") halves thereof can simply be pulled apart by the customer without tag alarming or setting of loss prevention systems at the exit. However, if the AMLP security tag is not removed after its deactivation, an EAS Non-Deactivatable Label ("NDL") disposed within the AMLP security tag alerts the customer and/or store personnel that the AMLP security tag is still attached to the article. This alert can occur prior to the customer's exiting of the store facility.

In some scenarios, the AMLP security tag incorporates the following features: (1) attracting magnets located in the two MA halves thereof; (2) an RFID inlay; (3) an EAS NDL; (4) a magnetic read switch; (5) alarming/deactivation circuitry; (6) output devices (e.g., a piezoelectric buzzer and speaker, a light emitting diode, a display); (7) a power source (e.g., a battery); and (8) NFC circuitry/capability.

Notably, the AMLP tag solution is compatible with existing Acousto-Magnetic ("AM") detection systems and RFID enabled inventory tracking systems. Also, a store associate is not required or needed for removing the security tag from the item. Additionally, the self-detaching solution facilitates MPOS applications because the need for a dedicated detacher device (i.e., one in which the security tag must be disposed for detaching the same from an item) has been eliminated.

Exemplary Systems for Customer Detachment of Security Tags

The present disclosure generally relates to systems and methods for operating a security tag of an EAS system. The methods involve: receiving a request to detach an AMLP security tag from an article; generating a signal including a command for deactivating alarming operations of an AMLP security tag; and wirelessly communicating the signal to the AMLP security tag for causing the deactivation of the alarming operations so that an alarm is not issued when the two MA halves of the AMLP security tag are pulled apart.

Referring now to FIG. 1, there is provided a schematic illustration of an exemplary system 100 that is useful for understanding the present invention. System 100 is generally configured to allow a customer to purchase an article 102 using a Mobile Communication Device ("MCD") 104 and an optional Peripheral Device ("PD") 190 thereof. PD 190 is designed to be mechanically attached to the MCD 104. In some scenarios, PD 190 wraps around at least a portion of MCD 104. Communications between MCD 104 and PD 190 are achieved using a wireless Short Range Communication ("SRC") technology, such as a Bluetooth technology. PD 190 also employs other wireless SRC technologies to facilitate the purchase of article 102. The other wireless SRC technologies can include, but are not limited to, Near Field Communication ("NFC") technology, Infra-Red ("IR") technology, Wireless Fidelity ("Wi-Fi") technology, Radio Frequency Identification ("RFID") technology, and/or ZigBee technology. PD 190 may also employ barcode technology, electronic card reader technology, and Wireless Sensor Network ("WSN") communications technology.

As shown in FIG. 1, system 100 comprises a Retail Store Facility ("RSF") 150 including an EAS system 130. The EAS system 130 comprises a monitoring system 134 and at least one AMLP security tag 132. Although not shown in FIG. 1, the AMLP security tag 132 is attached to article 102, thereby protecting the article 102 from an unauthorized removal from the RSF 150. The monitoring system 134 establishes a surveillance zone (not shown) within which the presence of the AMLP security tag 132 can be detected. The surveillance zone is established at an access point (not shown) for the RSF 150. If the AMLP security tag 132 is carried into the surveillance zone, then an alarm is triggered to indicate a possible unauthorized removal of article 102 from the RSF 150.

During store hours, a customer 140 may desire to purchase the article 102. The customer 140 can purchase the article 102 without using a traditional fixed POS station (e.g., a checkout counter). Instead, the purchase transaction can be achieved using MCD 104 and/or PD 190. MCD 104 (e.g., a mobile phone or tablet computer) can be in the possession of the customer 140 or store associate 142 at the time of the purchase transaction. Notably, MCD 104 has a retail transaction application installed thereon that is configured to facilitate the purchase of article 102 and the management/control of PD 190 operations for an attachment/detachment of the AMLP security tag 132 to/from article 102. The retail transaction application can be a preinstalled application, an add-on application or a plug-in application.

In order to initiate a purchase transaction, the retail transaction application is launched via a user-software interaction. The retail transaction application facilitates the exchange of data between the article 102, the AMLP security tag 132, customer 140, store associate 142, and/or Retail Transaction System ("RTS") 118. For example, after the retail transaction application is launched, a user 140, 142 is prompted to start a retail transaction process for purchasing the article 102. The retail transaction process can be started simply by performing a user software interaction, such as depressing a key on a keypad of the MCD 104 or touching a button on a touch screen display of the MCD 104.

Subsequently, the user 140, 142 may manually input into the retail transaction application article information. Alternatively or additionally, the user 140, 142 places the MCD 104 in proximity of article 102. As a result of this placement, the MCD 104 and/or PD 190 obtains article information from the article 102. The article information includes any information that is useful for purchasing the article 102, such as an article identifier and an article purchase price. In some scenarios, the article information may even include an identifier of the AMLP security tag 132 attached thereto. The article information can be communicated from the article 102 to the MCD 104 and/or PD 190 via a short range communication, such as a barcode communication 122 or an NFC 120. In the barcode scenario, the article 102 has a barcode 128 attached to an exposed surface thereof. In the NFC scenarios, the article 102 may comprise an NFC enabled device 126. If the PD 190 obtains the article information, then it forwards it to MCD 104 via a wireless SRC, such as a Bluetooth communication.

Thereafter, payment information is input into the retail transaction application of MCD 104 by the user 140, 142. Upon obtaining the payment information, the MCD 104 automatically performs operations for establishing a retail transaction session with the RTS 118. The retail transaction session can involve: communicating the article information and payment information from MCD 104 to the RTS 118 via an RF communication 124 and public network 106 (e.g., the Internet); completing a purchase transaction by the RTS 118; and communicating a response message from the RTS 118 to MCD 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Apple-Pay®).

The purchase transaction can be completed by the RTS 118 using the article information and payment information. In this regard, such information may be received by a computing device 108 of the RTS 118 and forwarded thereby to a sub-system of a private network 110 (e.g., an Intranet). For example, the article information and purchase information can also be forwarded to and processed by a purchase sub-system 112 to complete a purchase transaction. When the purchase transaction is completed, a message is generated and sent to the MCD 104 indicating whether the article 102 has been successfully or unsuccessfully purchased. In some scenarios, a red LED would be activated prior to payment being authorized. Once authorized, a green LED would be activated. The present invention is not limited to the particulars of this example.

If the article 102 has been successfully purchased, then a security tag detaching process can be started automatically by the RTS 118 or by the MCD 104. Alternatively, the user 140, 142 can start the security tag detaching process by performing a user-software interaction using the MCD 104. In all three scenarios, the article information can optionally be forwarded to and processed by a lock release sub-system 114 to retrieve a detachment key or a detachment code that is useful for detaching the AMLP security tag 132 from the article 102. The detachment key or code is then sent from the RTS 118 to the MCD 104 such that the MCD 104 can perform or cause the PD 190 to perform tag detachment operations. The tag detachment operations are generally configured to cause the AMLP security tag 132 to deactivate alarm operations thereof. In this regard, the MCD or PD generates an alarm deactivation command and sends a wireless alarm deactivation signal including the alarm deactivation command to the AMLP security tag 132. The AMLP security tag 132 authenticates the alarm deactivation command and deactivates its alarming operations. At this time, the two MA halves of the AMLP security tag can be pulled apart without issuance of the security tag's internal alarm. Once the AMLP security tag 132 has been removed from article 102, the customer 140 can carry the article 102 through the surveillance zone without setting off the alarm of the EAS system.

Figure 2:
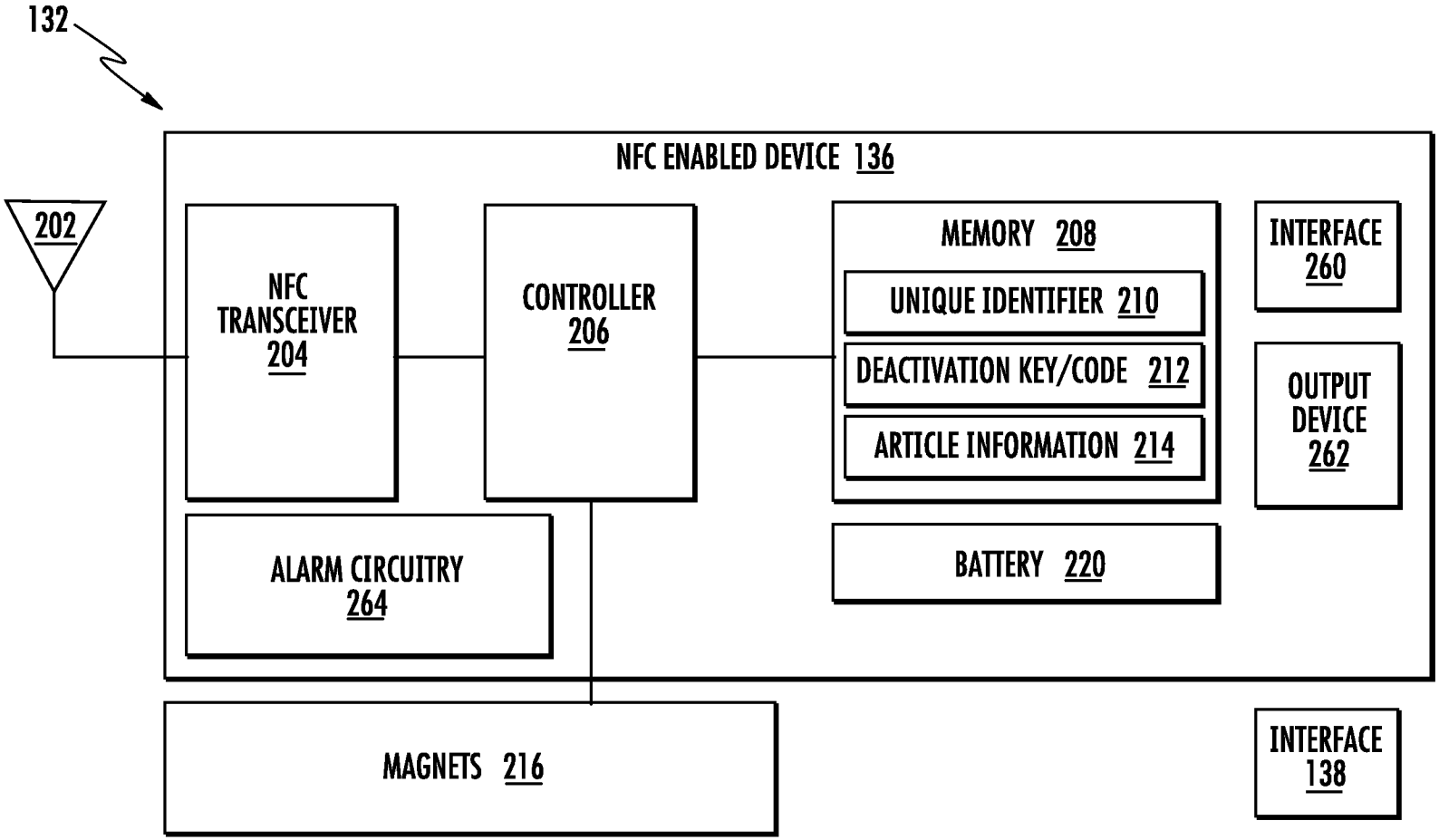
FIG. 2 is a block diagram of an exemplary architecture for a security tag shown in FIG. 1.

Referring now to FIG. 2, there is provided a schematic illustration of an exemplary architecture for the AMLP security tag 132. The AMLP security tag 132 can include more or less components than that shown in FIG. 2. However, the components shown are sufficient to disclose an illustrative embodiment implementing the present invention. Some or all of the components of the AMLP security tag 132 can be implemented in hardware, software and/or a combination of hardware and software. The hardware includes, but is not limited to, one or more electronic circuits.

The hardware architecture of FIG. 2 represents an embodiment of a representative AMLP security tag 132 configured to facilitate the prevention of an unauthorized removal of an article (e.g., article 102 of FIG. 1) from an RSF (e.g., RSF 150 of FIG. 1). In this regard, the AMLP security tag 132 may have a barcode 138 affixed thereto for allowing data to be exchanged with an external device (e.g., PD 190 of FIG. 1) via barcode technology.

The AMLP security tag 132 also comprises an antenna 202 and an NFC enabled device 136 for allowing data to be exchanged with the external device via NFC technology. The antenna 202 is configured to receive NFC signals from the external device and transmit NFC signals generated by the NFC enabled device 136. The NFC enabled device 136 comprises an NFC transceiver 204. NFC transceivers are well known in the art, and therefore will not be described herein. However, it should be understood that the NFC transceiver 204 processes received NFC signals to extract information therein. This information can include, but is not limited to, a request for certain information (e.g., a unique identifier 210), and/or a message including information specifying a detachment key or code for detaching the AMLP security tag 132 from an article. The NFC transceiver 204 may pass the extracted information to the controller 206.

If the extracted information includes a request for certain information, then the controller 206 may perform operations to retrieve a unique identifier 210 and/or article information 214 from memory 208. The article information 214 can include a unique identifier of an article and/or a purchase price of the article. The retrieved information is then sent from the AMLP security tag 132 to a requesting external device (e.g., PD 190 of FIG. 1) via an NFC communication.

In contrast, if the extracted information includes information specifying a one-time-only use key and/or instructions for programming the AMLP security tag 132 to deactivate alarming operations thereof (e.g., issuance of an alarm when two magnetic halves are pulled apart), then the controller 206 may perform operations to simply deactivate said alarming operations using the one-time-only key. Alternatively or additionally, the controller 206 can: parse the information from a received message; retrieve a deactivation key/code 212 from memory 208; and compare the parsed information to the deactivation key/code to determine if a match exists therebetween. If a match exists, then the controller 206 generates and sends a command to alarm circuitry 264 for deactivating operations thereof. The alarming circuitry 264 can include, but is not limited to, a magnetic reed switch and a piezoelectric buzzer/speaker. An auditory or visual indication can be output by output device(s) 262 of the AMLP security tag 132 when the alarming operations are deactivated. If a match does not exist, then the controller 206 may generate a response message indicating that detachment key/code specified in the extracted information does not match the detachment key/code 212 stored in memory 208. The response message may then be sent from the AMLP security tag 132 to a requesting external device (e.g., PD 190 of FIG. 1) via a wireless short-range communication or a wired communication via interface 260. A message may also be communicated to another external device or network node via interface 260.

In some scenarios, the connections between components 204, 206, 208, 216, 260, 262, 264 are unsecure connections or secure connections. The phrase "unsecure connection", as used herein, refers to a connection in which cryptography and/or tamper-proof measures are not employed. The phrase "secure connection", as used herein, refers to a connection in which cryptography and/or tamper-proof measures are employed. Such tamper-proof measures include enclosing the physical electrical link between two components in a tamper-proof enclosure.

Notably, the memory 208 may be a volatile memory and/or a non-volatile memory. For example, the memory 208 can include, but is not limited to, a Random Access Memory ("RAM"), a Dynamic Random Access Memory ("DRAM"), a Static Random Access Memory ("SRAM"), a Read-Only Memory ("ROM") and a flash memory. The memory 208 may also comprise unsecure memory and/or secure memory. The phrase "unsecure memory", as used herein, refers to memory configured to store data in a plain text form. The phrase "secure memory", as used herein, refers to memory configured to store data in an encrypted form and/or memory having or being disposed in a secure or tamper-proof enclosure.

The components 204-208, 260-264 and a battery 220 may be collectively referred to herein as the NFC enabled device 136. The NFC enabled device 136 can be incorporated into a device which also houses the magnets 216, or can be a separate device. The NFC enabled device 136 is coupled to a power source. The power source may include, but is not limited to, battery 220 or an A/C power connection (not shown). Alternatively or additionally, the NFC enabled device 136 is configured as a passive device which derives power from an RF signal inductively coupled thereto. In some scenarios, the battery 220 can be inductively recharged or thru a USB type connector. Techniques for inductively recharging power sources are well known in the art, and therefore will not be described herein. Any known or to be known inductive charging technique can be used herein without limitation.

Exemplary Security Tag Architectures

Exemplary architectures for an AMLP security tag 300 will now be described in detail in relation to FIGS. 3A-3C. AMLP security tag 132 is the same as or similar to AMLP security tag 300. As such, the following discussion of AMLP security tag 300 is sufficient for understanding various features of AMLP security tag 132.

Figure 3A:
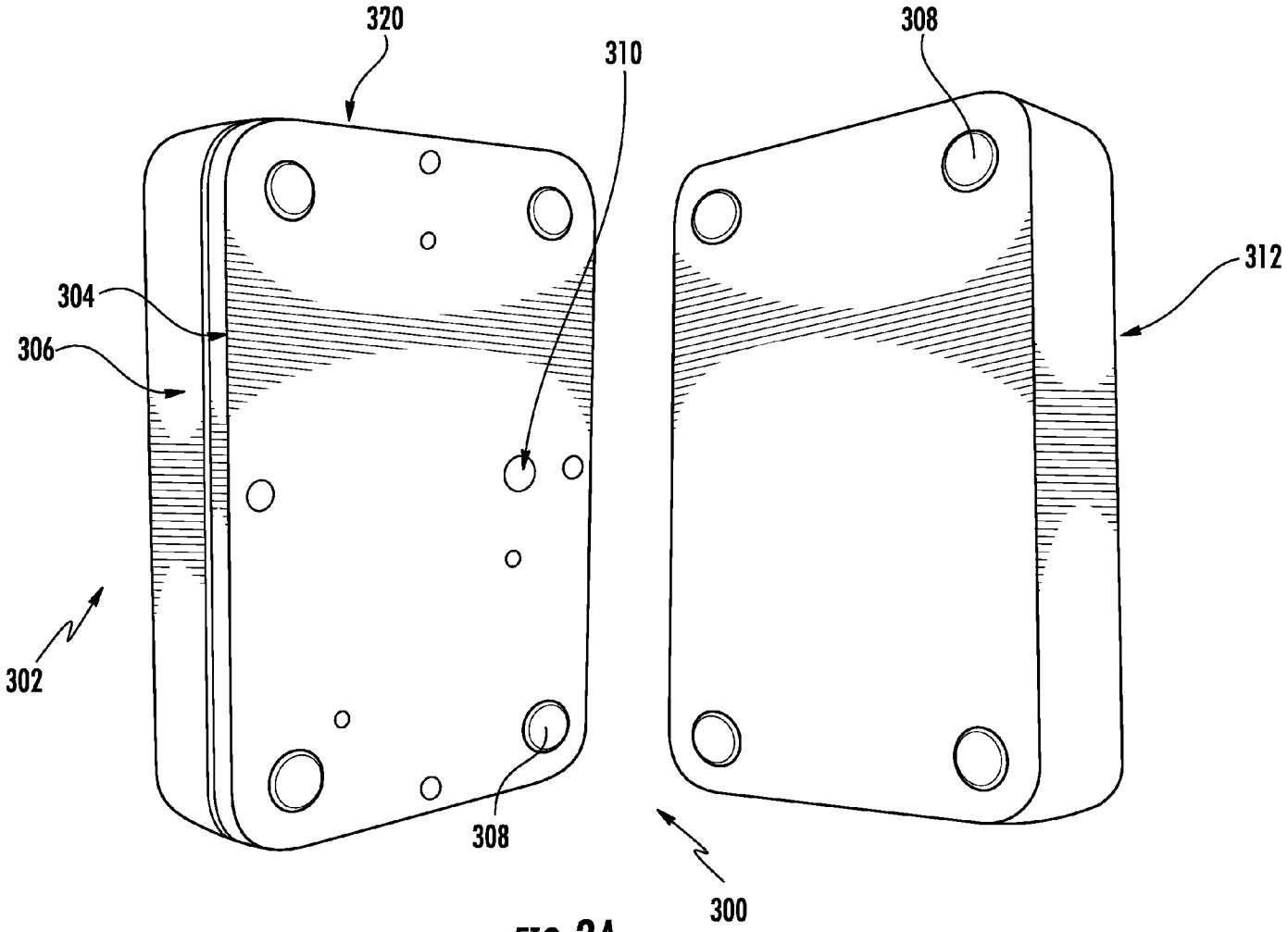
FIGS. 3A-3C each provide a perspective view of an exemplary security tag.
Figure 3B:
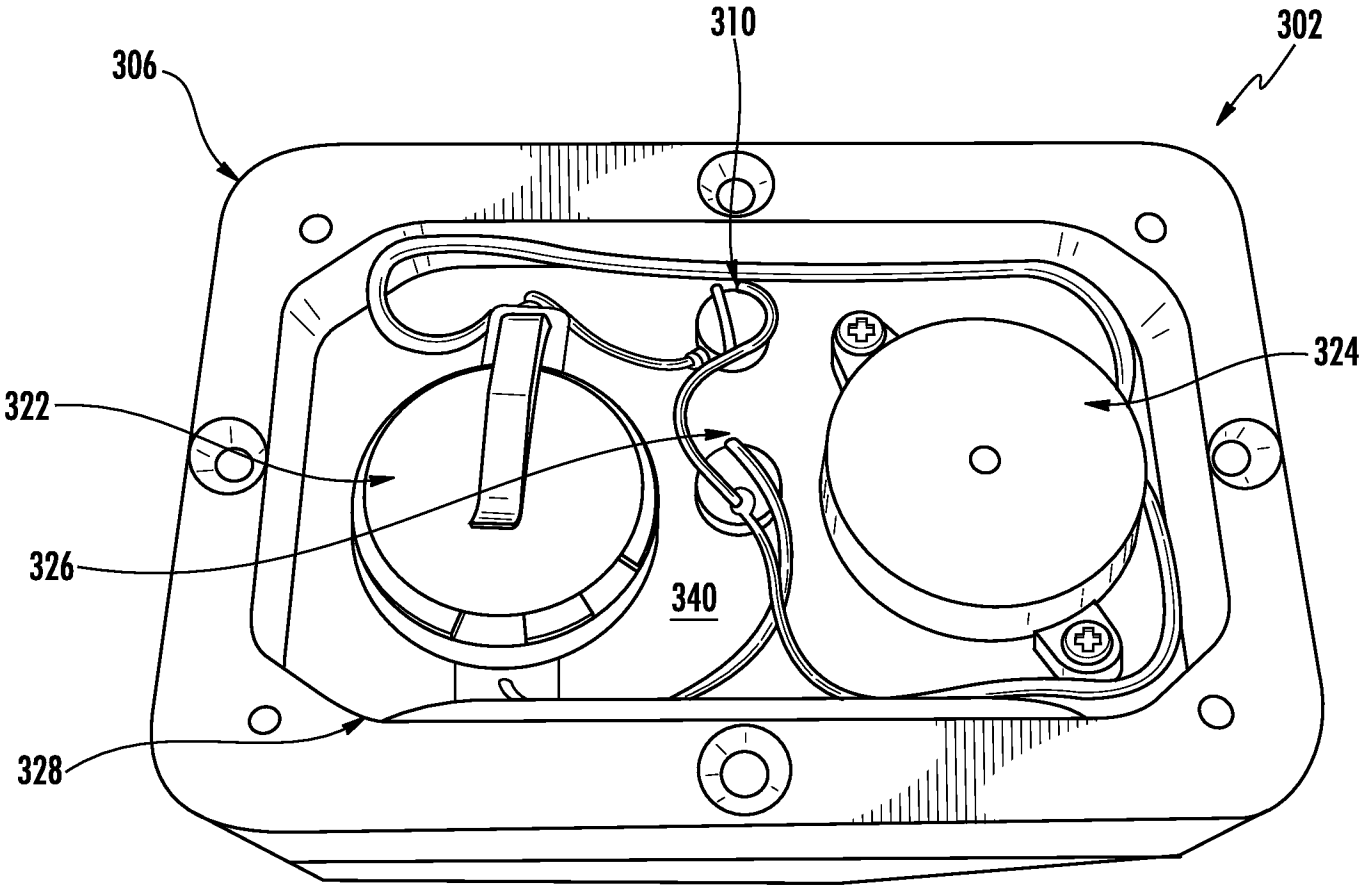
Figure 3C:
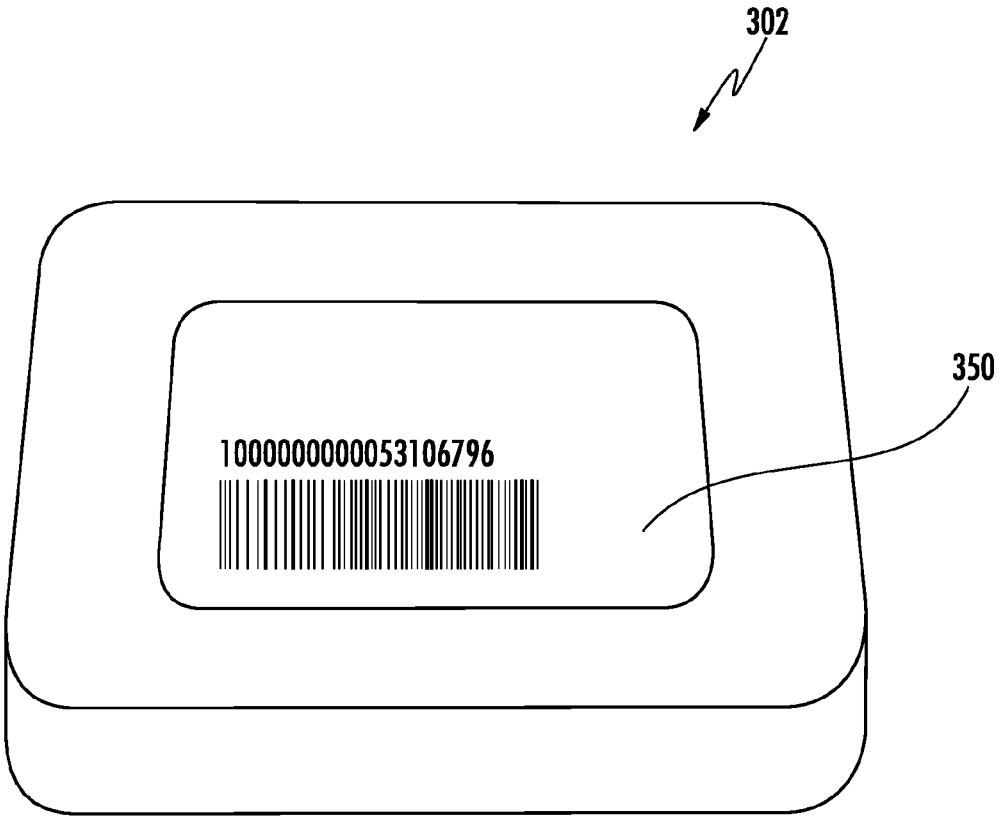

As shown in FIGS. 3A-3C, the AMLP security tag 300 comprises a hard EAS tag formed of two MA halves 302, 312. The two MA halves 302, 312 can be the same or substantially similar. For example, both MA halves 302, 312 may comprise a magnet 324 and other circuitry 340. Circuitry 340 may comprise a Printed Circuit Board ("PCB"). Alternatively or additionally, the circuitry 340 is integrally formed with the MA halves' housing. The integration of circuitry 340 with the housing can provide a security tag with a relatively smaller overall form factor.

Circuitry 340 may include an antenna (e.g., antenna 202 of FIG. 2) and NFC enabled device (e.g., NFC enabled device 136 of FIG. 2). However, the NFC enabled device may be entirely contained in only one MA half, such as MA half 302. In this case, MA half 302 additionally also comprises a battery 322, a magnetic reed switch 326 and a light emitting diode 310. Alternatively, a portion of the NFC enabled device is contained in each half 302 and 312.

For each MA half, the magnet and/or NFC enabled device is disposed within an enclosure 320. An EAS and/or RFID element 328 may be housed within the enclosure 320. The EAS element may include, but is not limited to, an NDL. Additionally or alternatively, an RFID and barcode codes 350 is printed or coupled to an exposed surface of the enclosure 320. The enclosure 320 is defined by first and second housing portions 304, 306 that are securely coupled to each other (e.g., via an adhesive, an ultrasonic weld and/or mechanical couplers 308 such as screws).

Figure 4:
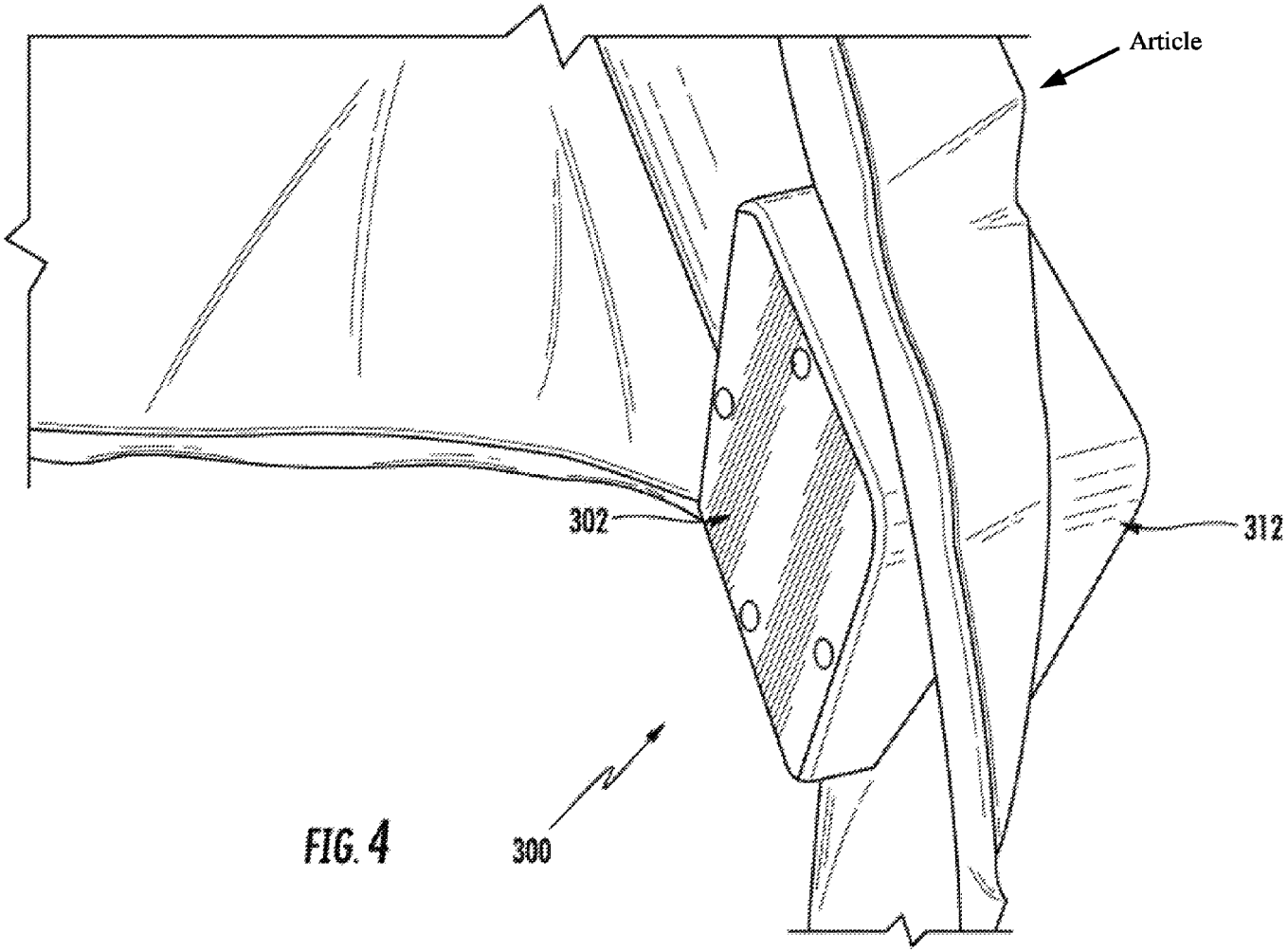
FIG. 4 shows a security tag coupled to a piece of clothing.

The magnets 324 allow the AMLP security tag 300 to be coupled to at least a portion of an article (e.g., article 102 of FIG. 1), as shown in FIG. 4. The coupling is achieved by clamping the article between the two MA halves 302, 312. Notably, an internal alarm (not shown in FIGS. 3A-3C) will issue when the two MA halves 302, 312 are pulled apart. In this case, it should be understood that the magnetic reed switch 326 is normally closed so as to form a closed alarming circuit. The magnetic reed switch 326 is actuated to an open position so as to form an open alarming circuit when the two MA halves 302, 312 are placed in proximity to each other. When the magnetic reed switch 326 is in its closed position, an internal alarm of the security tag is issued. The internal alarm can be deactivated when a successful purchase transaction of the article has been verified.

A light emitting diode 310 is provided to indicate when the alarm is activated and when the alarm is deactivated. For example, when the light emitting diode 310 is red, the alarm is activated. In contrast, when the light emitting diode 310 is green, the alarm is deactivated.

Figure 7:
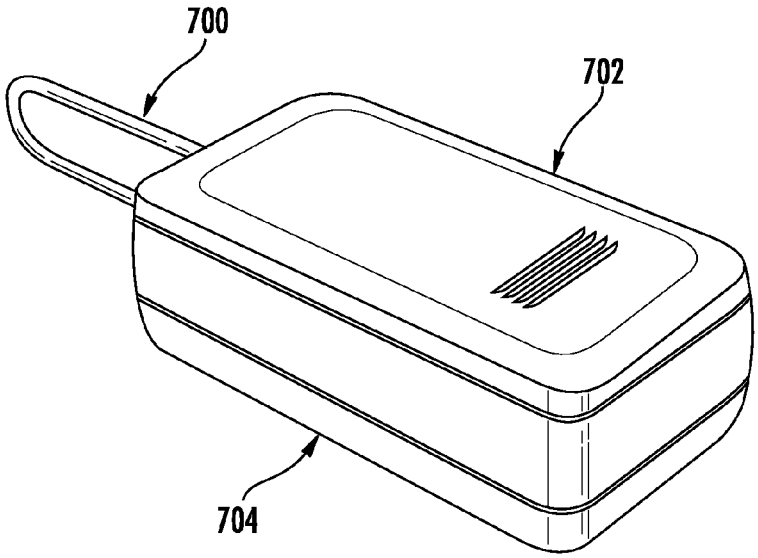
FIGS. 7-8 provide schematic illustrations of another exemplary architecture for a security tag.
Figure 8:
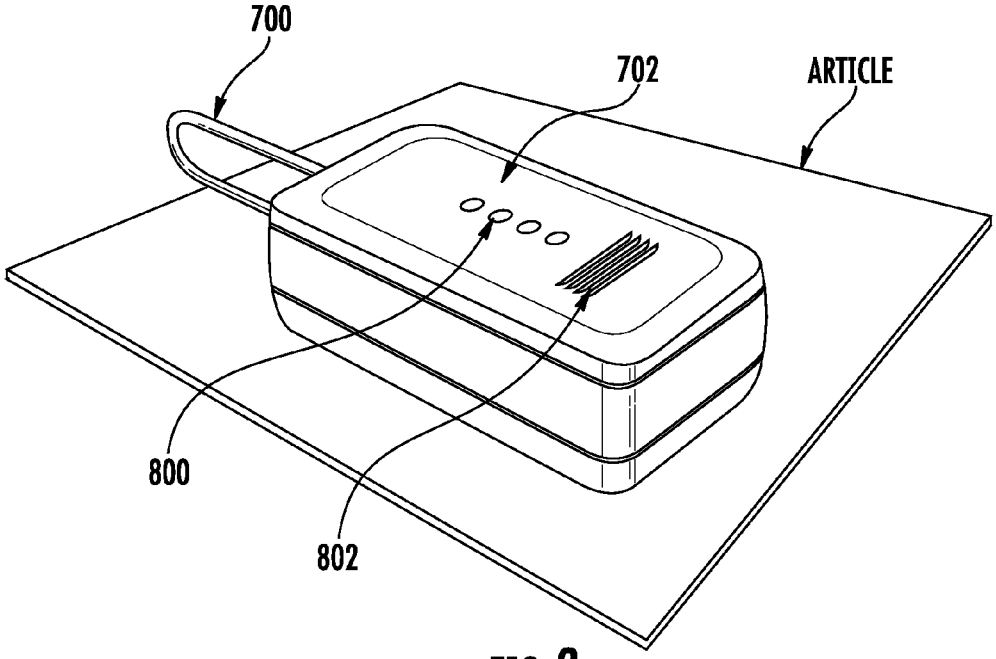

Another exemplary architecture for a security tag is shown in FIGS. 7-8. As shown in FIGS. 7-8, a lanyard 700 is provided to couple the first and second MA halves 702, 704 together. In some scenarios, the lanyard 700 is configured to supply power from the first MA half 702 to the second MA half 704 for powering circuitry disposed therein, or vice versa. The security tag can have an alarming feature for indicating if and when the lanyard has been tampered with (such as cut) by an unauthorized person.

At least one of the MA halves 702, 704 may also have a depression and/or ridge (not shown) formed thereon to facilitate the pulling apart thereof. The depression and/or ridge can have any shape selected in accordance with a particular application. For example, the depression has a semi-circular cross-sectional profile. Additionally or alternatively, the ridge has a rectangular cross-sectional profile. The present invention is not limited to the particulars of this example.

The first MA half 702 has apertures (not shown) and/or a transparent surface 800 for enabling visual alerts to be provided to a user of the security tag. The visual alerts may be implemented by LEDs. A speaker grill 802 is also formed in the first MA half 702. The location of the visual alert mechanism 800 and/or speaker grill 802 on the first MA half 702 is not limited to that shown in FIGS. 7-8.

Exemplary Methods for Operating a Security Tag

Figure 5:
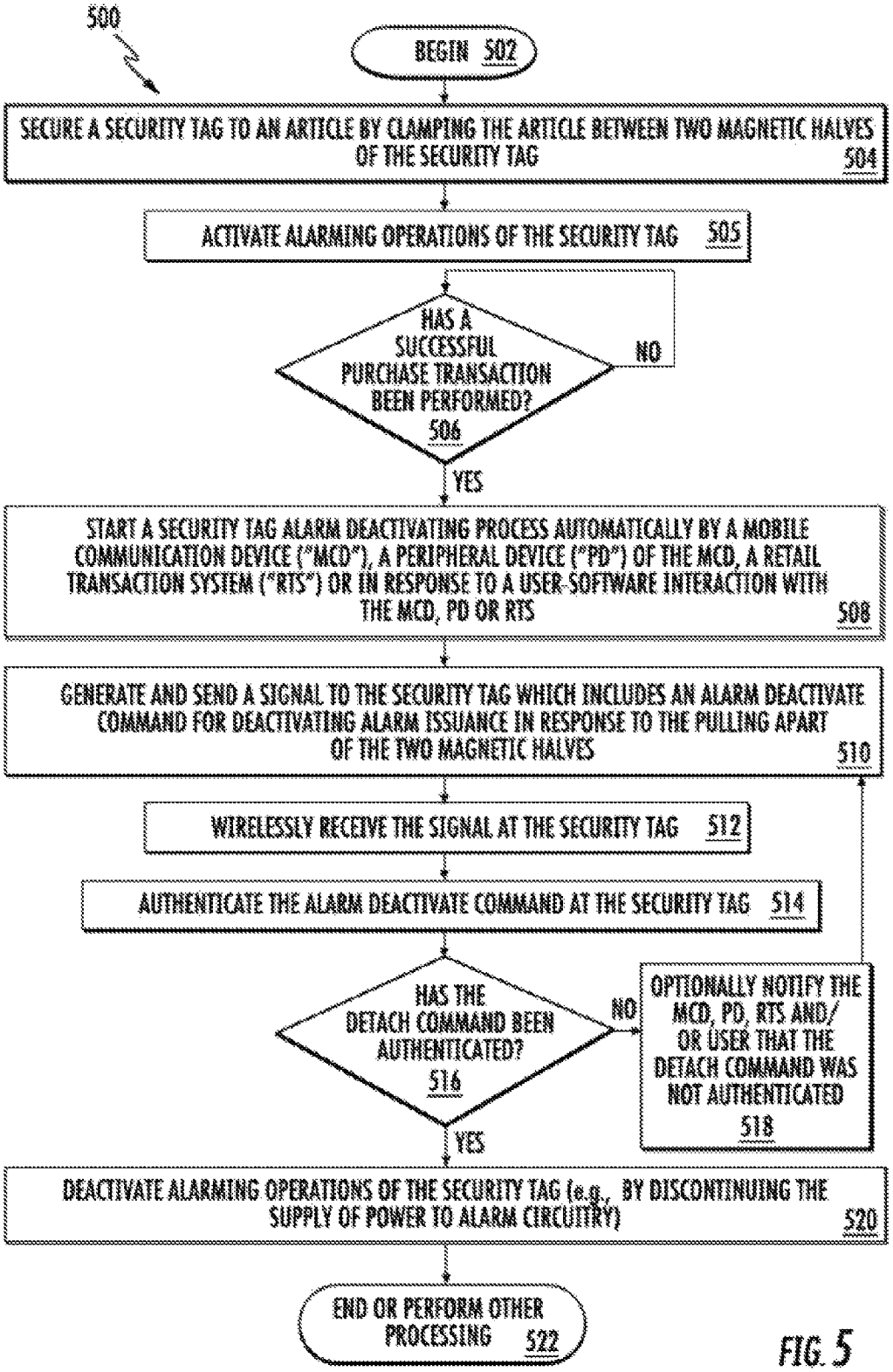
FIG. 5 is a flow chart of an exemplary method for operating a security tag.

Referring now to FIG. 5, there is provided a flow diagram of an exemplary method 500 for operating an AMLP security tag. Method 500 begins with step 502 and continues with step 504 where an AMLP security tag (e.g., security tag 132 of FIG. 1 or 300 of FIG. 3) is attached to an article (e.g., article 102 of FIG. 1). This step involves clamping the article between two MA halves of the AMLP security tag. At this time, alarming operations of the AMLP security tag can be activated as shown by step 505.

Sometime thereafter, a decision step 506 is performed to determine if a purchase transaction has been successfully performed. If the purchase transaction was not successful [506:NO], then method 500 repeats step 506. In contrast, if the purchase transaction was successful [506:YES], then step 508 is performed where a security tag alarm deactivating process is automatically begun by an MCD (e.g., MCD 104 of FIG. 1), a PD (e.g., PD 190 of FIG. 1), an RTS (e.g., RTS 118 of FIG. 1) or in response to a user-software interaction with the MCD, PD or RTS. The security tag alarm deactivating process involves the operations performed in steps 510-520. These steps involve: generating and sending a signal to the AMLP security tag which includes an alarm deactivate (or deactivation) command for deactivating alarm issuance in response to the pulling apart of the two MA halves of the AMLP security tag; wirelessly receiving the signal at the AMLP security tag; and authenticating the alarm deactivate command at the AMLP security tag.

If the alarm deactivate command is not authenticated [516:NO], then optional step 518 is performed where the MCD, PD, RTS and/or user is(are) notified that the alarm deactivation command was not authenticated by the AMLP security tag. Subsequently, method 500 returns to step 510.

If the alarm deactivate command is authenticated [516: YES], then the alarming operations of the AMLP security tag are deactivated as shown by step 520. Such deactivation can be achieved simply by discontinuing the supply of power to alarm circuitry (e.g., alarm circuitry 264 of FIG. 2). Upon completing step 520, step 522 is performed where method 500 ends or other processing is performed.

Referring now to FIG. 6, there is provided a flow chart of another exemplary method 600 for operating an AMLP security tag (e.g., AMLP security tag 132 of FIG. 1 or 300 of FIG. 3). Method 600 begins with step 602. Although not shown in FIG. 6, it should be understood that user authentication operations and/or function enablement operations may be performed prior to step 602. For example, a user of an MCD (e.g., MCD 104 of FIG. 1) may be authenticated, and therefore one or more retail-transaction operations of the MCD may be enabled based on the clearance level of the user and/or the location to the MCD within an RSF (e.g., RSF 150 of FIG. 1). The location of the MCD can be determined using GPS information. In some scenarios, a "heart beat" signal may be used to enable the retail-transaction operation(s) of the MCD and/or PD (e.g., PD 190 of FIG. 1). The "heart beat" signal may be communicated directly to the MCD or indirectly to the MCD via the PD.

After step 602, method 600 continues with step 604 where a customer (e.g., customer 140 of FIG. 1) enters the RSF and accumulates one or more articles (e.g., article 102 of FIG. 1) to purchase. In some scenarios, the customer may then ask a store associate (e.g., store associate 142 of FIG. 1) to assist in the purchase of the accumulated articles. This may be performed when the customer 140 does not have an MCD (e.g., MCD 104 of FIG. 1) with a retail transaction application installed thereon and/or a PD (e.g., peripheral device 190 of FIG. 1) coupled thereto. If the customer is in possession of such an MCD, then the customer would not need the assistance from a store associate for completing a purchase transaction and/or detaching AMLP security tags from the articles, as shown by steps 606-614.

In next step 606, the customer performs user-software interactions with the MCD and/or PD so as to cause a retail transaction application installed on the MCD to be executed. The customer then uses the MCD and/or PD to scan each article for tendering, as shown by step 608. The scanning can be achieved using a barcode scanner, an RFID scanner, an NFC tag scanner, or any other short-range communication means of the MCD and/or PD. Alternatively or additionally, the customer may enter voice commands in order to confirm each article (s)he desires to purchase.

Once the articles have been scanned, payment information is input into the retail transaction application of the MCD, as shown by step 610. The payment information can include, but is not limited to, a customer loyalty code, payment card information, and/or payment account information. The payment information can be input manually using an input device of MCD or PD, via an electronic card reader (e.g., a magnetic strip card reader) of MCD or PD, and/or via a barcode reader of the MCD or PD.

After the payment information has been input into the retail transaction application, a decision step 612 is performed to determine if a purchase transaction has been completed. The purchase transaction can be completed using a web-based payment service (e.g., using PayPal®, Apple-Pay® or other cloud based online service). The determination of step 612 is made by the web-based payment service system based on information received from the MCD and/or an RTS (e.g., RTS 118 of FIG. 1). If the purchase transaction is not completed [612:NO], then method 600 returns to step 612. If the purchase transaction is completed [612:YES], then method 600 continues with step 614.

In step 614, the web-based payment service system generates and sends a purchase token to the MCD. The purchase token may also be communicated from the web-based payment service system and/or MCD to each security tag attached to a purchased item. The purchase token stored in a memory device of a security tag can be used later to (1) assist in determining why a failure occurred in relation to the security tag's detachment from the article and/or (2) whether a recently found security tag was removed from a purchased item or a stolen item. The manner in which (1) and (2) are resolved will be discussed below in detail.

Upon completing step 614, the MCD communicates the purchase token and unique identifiers of each purchased product from the MCD to a server (e.g., server 108 of FIG. 1) located at a corporate facility (e.g., corporate facility 152 of FIG. 1) via secure communications link, as shown by step 616. In a next step 618, the server performs operations to verify the purchase token using the web-based payment service. If the purchase token is not verified [620:NO], then method 600 returns to step 610. If the purchase token is verified [620:YES], then method 600 continues with step 622 of FIG. 6B.

Figure 6A:
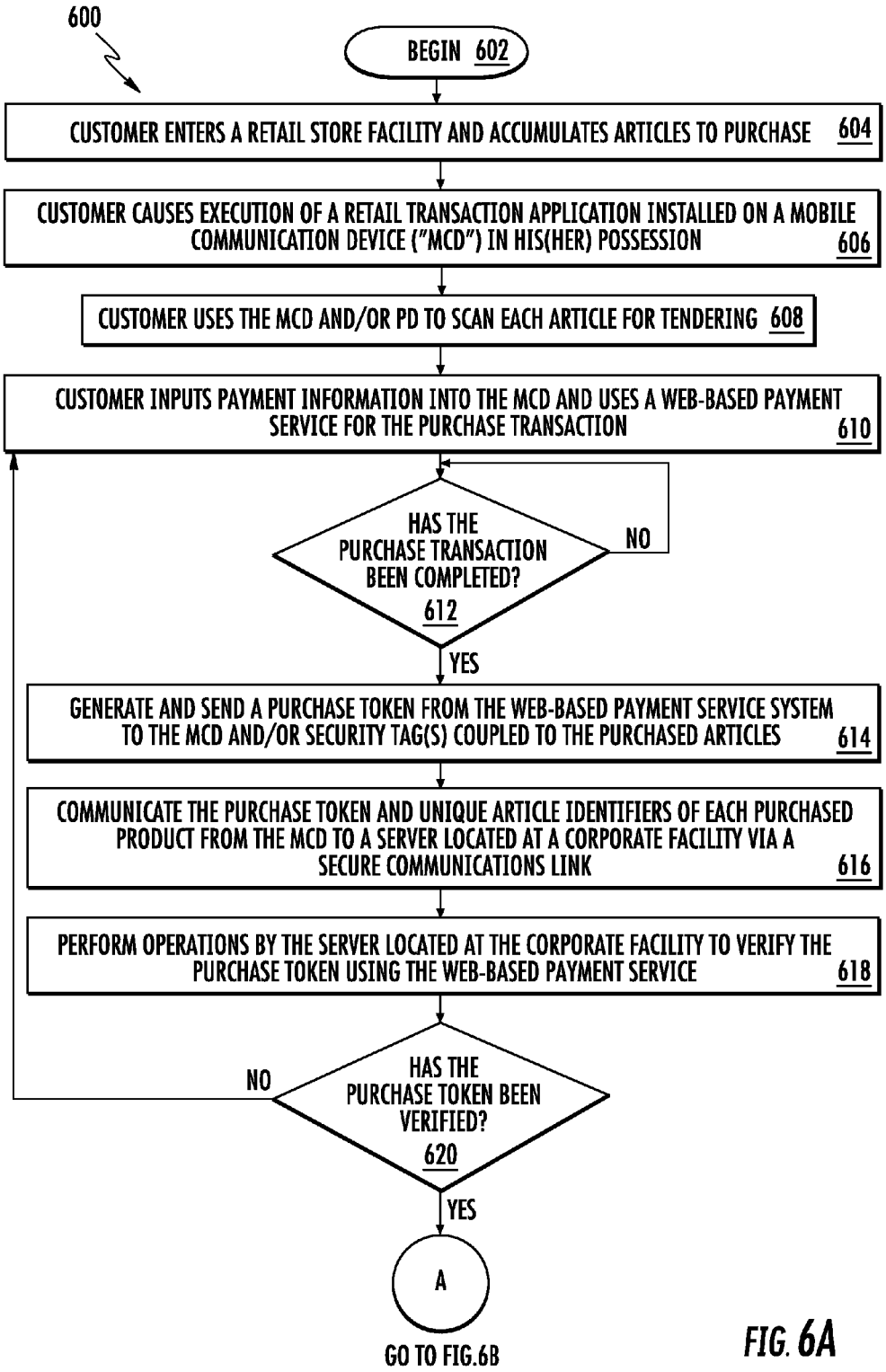
FIGS. 6A-6D (collectively referred to herein as "FIG. 6") provide a flow chart of another exemplary method for operating a security tag.
Figure 6B:
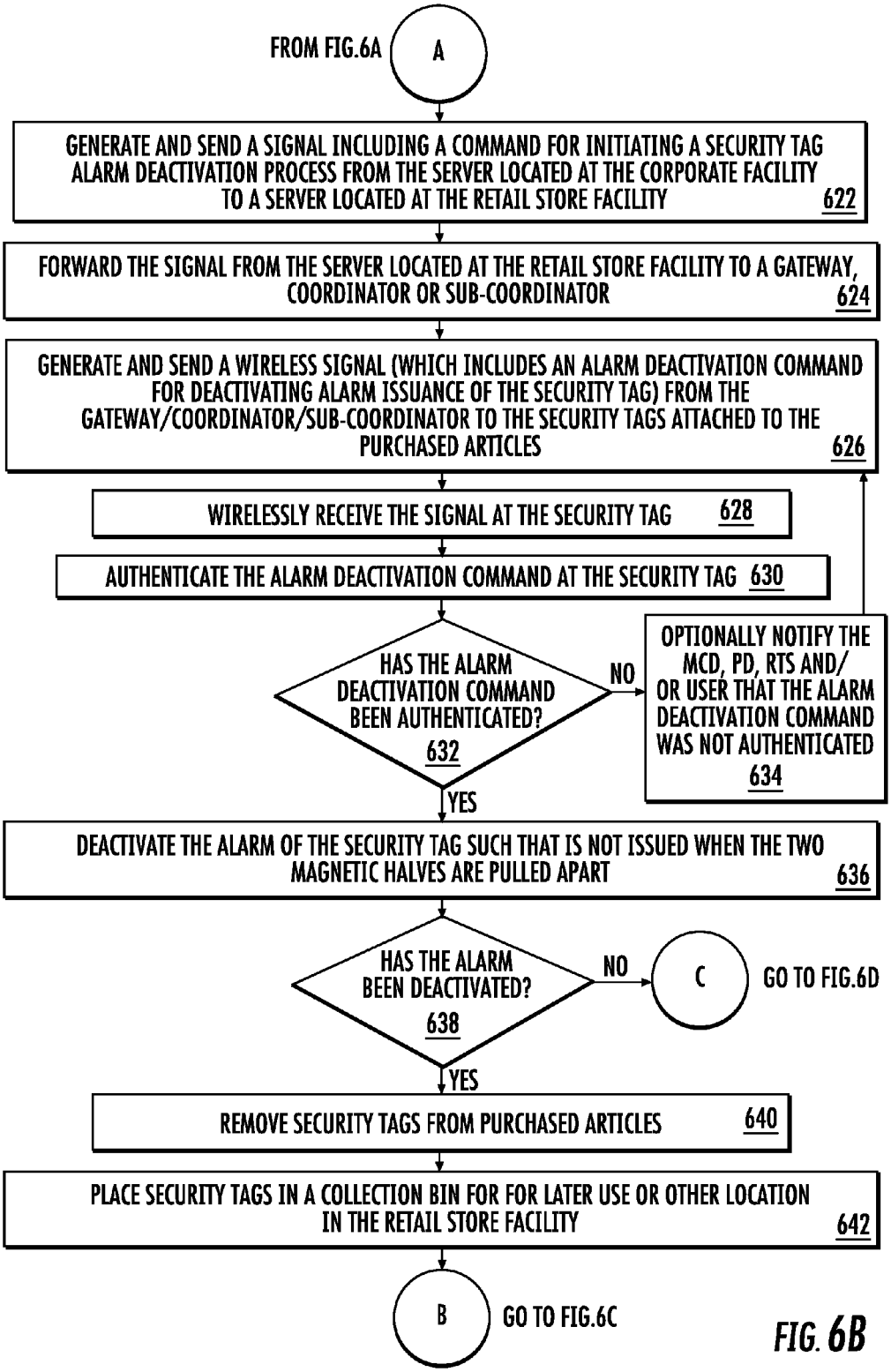
Figure 6C:
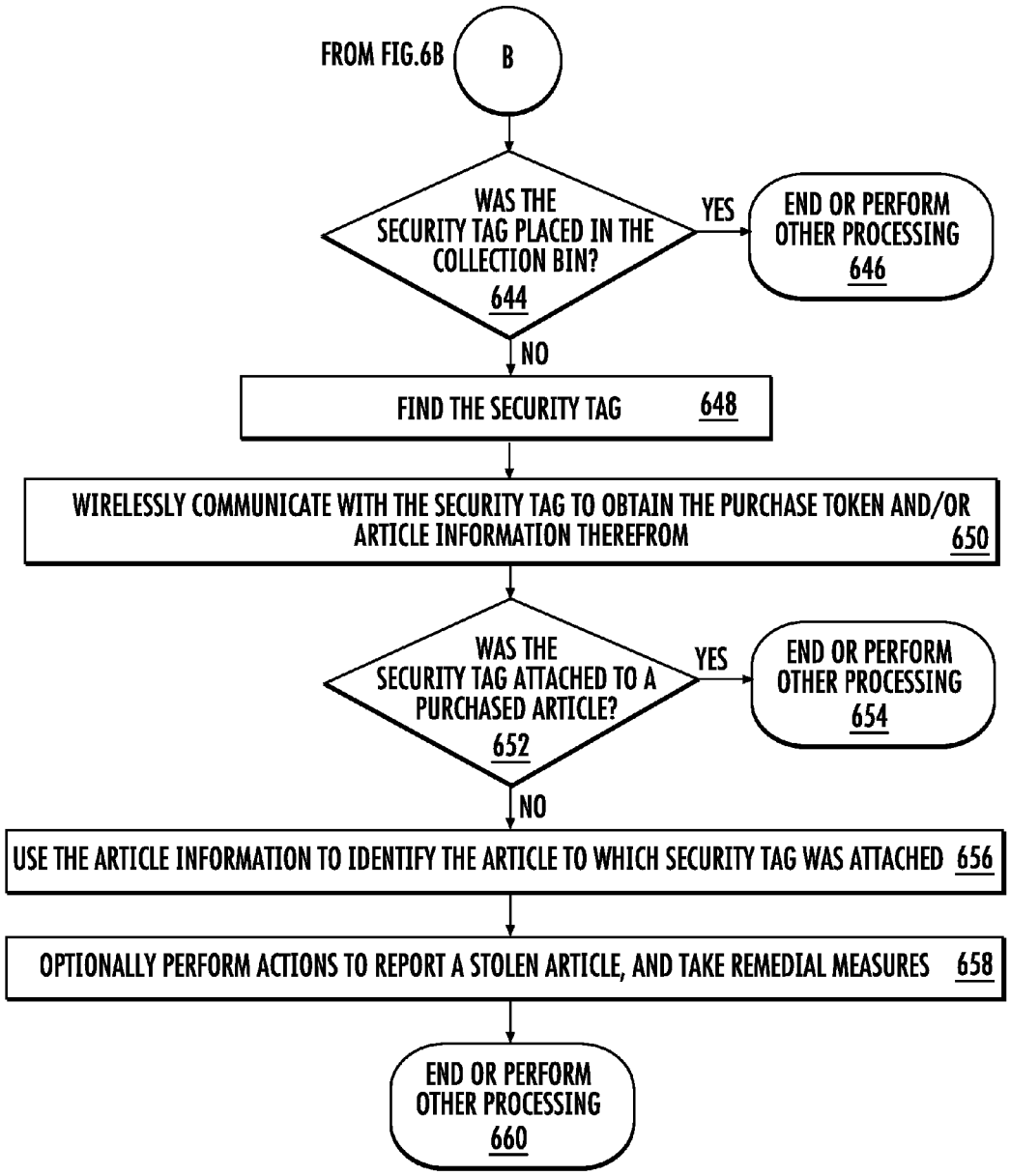

As shown in FIG. 6B, step 622 involves generating and sending a signal from the server located in the corporate facility to a server (e.g., server 192 of FIG. 1) located in an RSF (e.g., RSF 150 of FIG. 1). The signal includes a command for initiating a security tag alarm deactivation process. This signal is forwarded to a gateway (e.g., gateway 194 of FIG. 1), coordinator or sub-coordinator, as shown by step 624. At the gateway/coordinator/sub-coordinator, a wireless signal is generated which includes an alarm deactivation command for deactivating alarm issuance when two MA halves of the AMLP security tag are pulled apart, as shown by step 626. The wireless signal is then sent to the AMLP security tag(s).

After reception of the wireless signal in step 630, the AMLP security tag authenticates the alarm deactivation command. If the alarm deactivation command is not authenticated [632:NO], then optional step 634 is performed where the MCD, PD, RTS and/or user is(are) notified that the alarm deactivation command was not authenticated by the security tag. Subsequently, method 600 returns to step 626. If the alarm deactivation command is authenticated [632:YES], then the alarm is deactivated as shown by step 636. Such activation can be achieved simply by ceasing the supply of power to the alarm circuitry (e.g., alarm circuitry 264 of FIG. 2) of the AMLP security tag.

Next, a decision step 638 is performed to determine if the alarm had been deactivated. If the alarm has been deactivated [638:YES], then method 600 continues with step 640. In step 640, the AMLP security tag is removed from the article that has been successfully purchased. The removed AMLP security tag may be placed in a collection bin for later use or other location in the RSF (e.g., a dressing room), as shown by step 642. Subsequently, method 600 continues with a decision step 644 of FIG. 6C in which a determination is made as to whether or not the AMLP security tag was placed in the collection bin.

If the AMLP security tag was placed in the collection bin [644:YES], then step 646 is performed where method 600 ends or other processing is performed. In contrast, if the AMLP security tag was not placed in the collection bin [644:NO], then steps 648-650 are performed. These steps involve: finding the AMLP security tag (e.g., in a dressing room); and wirelessly communicating with the AMLP security tag to obtain the purchase token and/or article information therefrom. The purchase token and/or article information is then used to determine whether the AMLP security tag was attached to a purchased article. If the AMLP security tag was attached to a purchased item [652:YES], then step 654 is performed where method 600 ends or other processing is performed. If the AMLP security tag was not attached to a purchased item [652:NO], then steps 656-658 are performed. These steps involve: using the article information to identify the article to which the AMLP security tag was attached; optionally performing actions to report a stolen article; and optionally taking remedial measures. Subsequently, step 660 is performed where method 600 ends or other processing is performed.

Figure 6D:
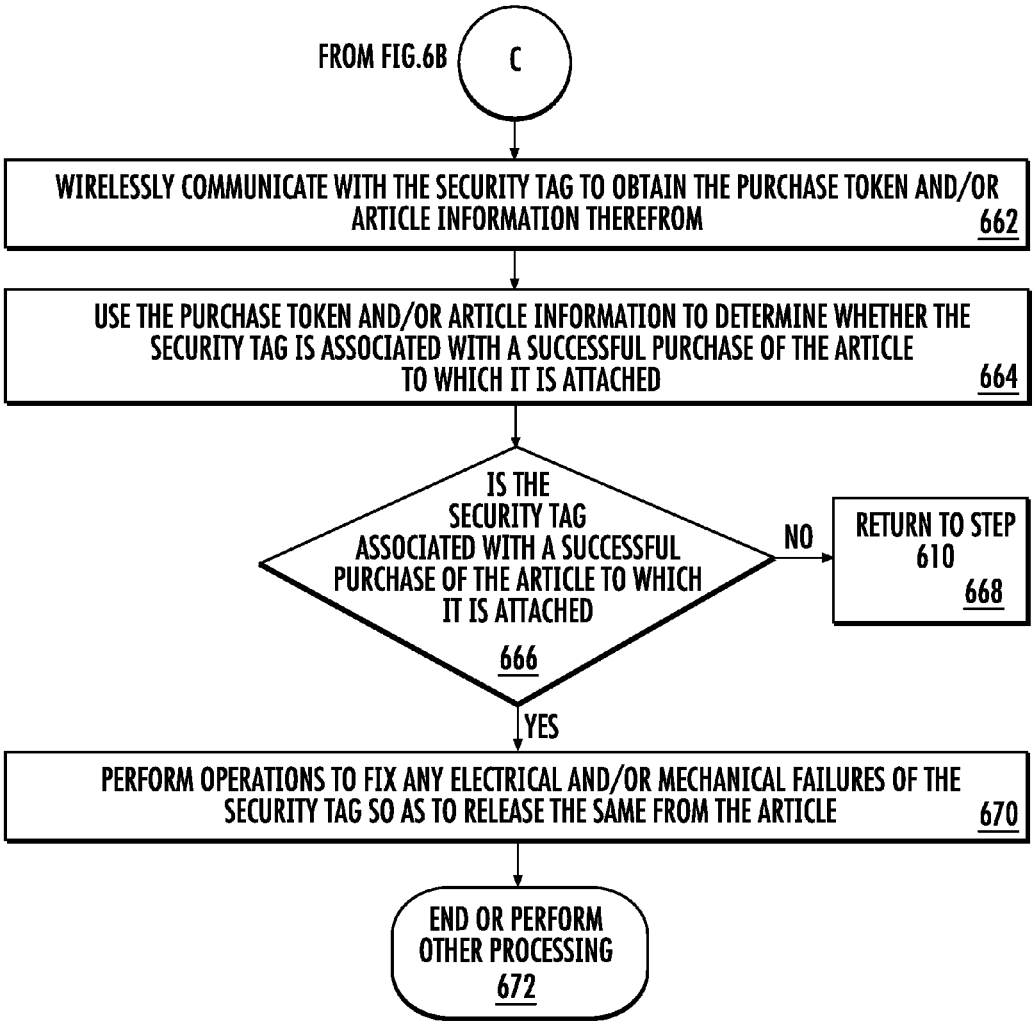

In contrast, if the alarm was not deactivated [638:NO], then method 600 continues with steps 662-670 of FIG. 6D. These steps involve: wirelessly communicating with the AMLP security tag to obtain the purchase token and/or article information therefrom; and using the purchase token and/or article information to determine whether the AMLP security tag is associated with a successful purchase of the article to which it is attached. If the AMLP security tag is not associated with a successful purchase of the article to which it is attached [666:NO], then step 668 is performed where method 600 returns to step 610 for re-performing the purchase transaction in relation to this particular article. If the AMLP security tag is associated with a successful purchase of the article to which it is attached [666:YES], then operations are performed to fix any electrical and/or mechanical failures of the AMLP security tag so as to release the same from the article. Subsequently, step 672 is performed where method 600 ends or other processing is performed.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for operating a security tag, comprising:

wirelessly receiving at the security tag a signal sent from a remote device; and preventing alarm issuance when first and second Magnetic Attracting ("MA") halves of the security tag are pulled apart by deactivating alarm circuitry internal to the security tag in response to the security tag's reception of the signal.

2. The method according to claim 1, further comprising outputting an alert indicating that the security tag has not been decoupled from an article after the alarm circuitry's deactivation.

3. The method according to claim 1, further comprising outputting an indication that the alarm circuitry has been deactivated so that a user knows when to pull the first and second MA halves of the security tag apart without alarm issuance.

4. The method according to claim 1, wherein the signal is sent from the remote device when a successful purchase of an article has occurred.

5. The method according to claim 1, wherein the alarm circuitry is deactivated by ceasing a supply of power to the alarm circuitry.

6. The method according to claim 1, wherein the first and second MA halves are able to be manually pulled apart by a user without assistance from a dedicated security tag detacher device.

7. The method according to claim 1, further comprising performing operations by the security tag, prior to preventing said alarm issuance, to authenticate an alarm deactivation command contained in the signal.

8. The method according to claim 1, further comprising clamping an article between the first and second MA halves.

9. The method according to claim 1, further comprising opening a switch disposed in the security tag by placing the first and second MA halves in proximity to each other.

10. The method according to claim 9, further comprising causing alarm issuance by placing the first and second MA halves a certain distance apart whereby the switch is closed.

11. A security tag, comprising:

first and second Magnetic Attracting ("MA") halves; and an electronic circuit disposed in at least one of the first and second MA halves that is configured to wirelessly receive a signal sent from a remote device, and prevent alarm issuance when the first and second MA halves are pulled apart by deactivating alarm circuitry in response to the security tag's reception of the signal.

12. The security tag according to claim 11, wherein the electronic circuit further causes an alert to be output indicating that the security tag has not been decoupled from an article after the alarm circuitry's deactivation.

13. The security tag according to claim 11, wherein the electronic circuit further causes an indication to be output indicating that the alarm circuitry has been deactivated so that a user knows when to pull the first and second MA halves apart without alarm issuance.

14. The security tag according to claim 11, wherein the signal is sent from the remote device when a successful purchase of an article has occurred.

15. The security tag according to claim 11, wherein the alarm circuitry is deactivated by ceasing a supply of power to the alarm circuitry.

16. The security tag according to claim 11, wherein the first and second MA halves are able to be manually pulled apart by a user without assistance from a dedicated security tag detacher device.

17. The security tag according to claim 11, wherein the electronic circuit further performs operations, prior to preventing said alarm issuance, to authenticate an alarm deactivation command contained in the signal.

18. The security tag according to claim 11, wherein the security tag is coupled to an article by clamping the article between the first and second MA halves.

19. The security tag according to claim 11, wherein the electronic circuit comprises a switch that is opened by placing the first and second MA halves in proximity to each other.

20. The security tag according to claim 19, wherein alarm issuance occurs when the switch is closed as a result of the first and second MA halves being placed a certain distance apart.

* * * * *